US007960662B2

(12) United States Patent
Ziaei

(10) Patent No.: US 7,960,662 B2
(45) Date of Patent: Jun. 14, 2011

(54) RADIOFREQUENCY OR HYPERFREQUENCY MICRO-SWITCH STRUCTURE AND METHOD FOR PRODUCING ONE SUCH STRUCTURE

(75) Inventor: Afshin Ziaei, Vanves (FR)

(73) Assignee: Thales (FR)

( * ) Notice: Subject to any disclaimer, the term of this patent is extended or adjusted under 35 U.S.C. 154(b) by 433 days.

(21) Appl. No.: 12/302,525

(22) PCT Filed: May 31, 2007

(86) PCT No.: PCT/EP2007/055358

§ 371 (c)(1),
(2), (4) Date: Nov. 26, 2008

(87) PCT Pub. No.: WO2007/138102

PCT Pub. Date: Dec. 6, 2007

(65) Prior Publication Data

US 2009/0236211 A1 Sep. 24, 2009

(30) Foreign Application Priority Data

May 31, 2006 (FR) ..... 06 04858

(51) Int. Cl.
*H01H 51/22* (2006.01)

(52) U.S. Cl. ..... 200/181; 200/600; 335/78

(58) Field of Classification Search ..... 29/622; 200/181, 600; 335/78; 257/9, 109, 415; 333/262; 438/53

See application file for complete search history.

(56) References Cited

U.S. PATENT DOCUMENTS

| | | | | |
|---|---|---|---|---|
| 5,619,061 | A * | 4/1997 | Goldsmith et al. | 257/528 |
| 6,426,687 | B1 * | 7/2002 | Osborn | 333/262 |
| 6,621,022 | B1 * | 9/2003 | Ma et al. | 200/267 |
| 6,657,832 | B2 * | 12/2003 | Williams et al. | 361/15 |
| 6,750,742 | B2 * | 6/2004 | Kang et al. | 333/262 |
| 7,002,441 | B2 * | 2/2006 | Pillans et al. | 335/78 |
| 7,042,397 | B2 | 5/2006 | Charrier et al. | |

(Continued)

FOREIGN PATENT DOCUMENTS

DE 10342938 4/2005

(Continued)

OTHER PUBLICATIONS

Jamie Yao et al. "Micromachined Low-Loss Microwave Switches." IEEE Journal of Microelectromechanical Systems, vol. 8, No. 2, Jun. 1999, pp. 129-134.XP011034850.

*Primary Examiner* — Michael A Friedhofer

(74) *Attorney, Agent, or Firm* — Lowe Hauptman Ham & Berner, LLP

(57) ABSTRACT

The micro-switch structure comprises, on a substrate 1 coated with a passivation layer 2, a first signal line LS-IN and a second signal line LS-OUT disposed in the projected extension of one another, separated by a switching region 10; a control electrode 3 in said region, a dielectric material 4 with high relative permittivity invariant in frequency, disposed on the control electrode in such a manner that, between the two signal lines, the control electrode is wider on either side and, in the orthogonal direction, the dielectric protrudes on either side of the control electrode and rests on the passivation layer; parallel ground lines, disposed symmetrically on either side of the signal lines and formed on a topological level separated from that of the signal lines by at least one insulating layer made of a material different from that of the passivation layer.

20 Claims, 7 Drawing Sheets

U.S. PATENT DOCUMENTS

| | | | | |
|---|---|---|---|---|
| 7,297,571 | B2 * | 11/2007 | Ziaei et al. | 438/106 |
| 7,546,677 | B2 * | 6/2009 | Lee et al. | 29/622 |
| 7,567,018 | B2 * | 7/2009 | Kawakubo et al. | 310/328 |
| 7,884,689 | B2 * | 2/2011 | Cetiner et al. | 335/78 |

FOREIGN PATENT DOCUMENTS

| | | |
|---|---|---|
| FR | 2841389 | 12/2003 |
| FR | 2845705 | 4/2004 |
| WO | WO0031819 | 6/2000 |

* cited by examiner

RADIOFREQUENCY OR HYPERFREQUENCY MICRO-SWITCH STRUCTURE AND METHOD FOR PRODUCING ONE SUCH STRUCTURE

CROSS-REFERENCE TO RELATED APPLICATIONS

The present Application is based on International Application No. PCT/EP2007/055358, filed on May 31, 2007, which in turn corresponds to French Application No. 0604858, filed on May 31, 2006, and priority is hereby claimed under 35 USC §119 based on these applications. Each of these applications are hereby incorporated by reference in their entirety into the present application.

FIELD OF THE INVENTION

The field of the invention is that of microsystem components usually referred to as MEMS (for Micro Electro Mechanical Systems) and, more particularly, to radiofrequency or microwave MEMS. The main fields of application are wireless telecommunications systems and radars.

In the following, the term 'radiofrequency' or 'RF' is used in a generic manner and is to be understood as covering both microwaves and radiofrequencies.

BACKGROUND OF THE INVENTION

According to the prior art for RF MEMS micro-switches, RF switching is obtained by varying the capacitance of a capacitor whose plates are formed, on the one hand, by a membrane and, on the other, by a facing control electrode, a dielectric being provided between the two capacitor plates generally on the electrode. The capacitance then varies from a value Con to a value Coff. The dielectric used can be silicon nitride. In other embodiments, the dielectric is PZT or BZT, or other material with high relative permittivity, which notably allows the ratio Con/Coff to be increased and hence the transmission and isolation properties of the micro-switch to be improved, together with its characteristic switching times between the two states on and off.

RF micro-switches are being increasingly employed in order to improve the functionalities of radiofrequency circuits used notably in telecommunications systems. The aim is to obtain improved performance in terms of losses, noise, linearity and power consumption. They are also used in order to obtain high levels of compactness of components, and to reduce the costs of fabrication as much as possible.

There exist two types of micro-switches providing a switching function for radiofrequency signals on a transmission line: micro-switches in series with the radiofrequency transmission line and micro-switches in parallel with the radiofrequency transmission line.

When the micro-switches are of the series type, the application of a activation voltage under the membrane makes it go from an idle off state, open, to the on state, closed. The configuration of a micro-switch in series with a radiofrequency line is the following: the line is interrupted in the switching region, above which is the membrane. The membrane is isolated from electrical ground. The membrane does not have to withstand the radiofrequency power over its whole surface, its role not being to short-circuit the signal to ground but simply to connect two lines together by a capacitive effect.

When the micro-switches are of the parallel type, the application of a voltage to the control electrode makes it go from an idle on state, closed, to an open off state. The configuration of a micro-switch in parallel with a radiofrequency line is the following: the line RF is not interrupted in the switching region, above which is the membrane. The membrane is connected to electrical ground and must be capable of handling the power of the radiofrequency signal.

The operation is as follows: in the idle position, the micro-switch is in the on state, closed, which corresponds to a very low capacitance Coff, which does not affect the radiofrequency signal transmission. When it is in the low state, under the effect of an activation voltage under the membrane, the capacitance increases by a large factor, 100 for example. The capacitor then presents an impedance between the line and ground that is sufficiently low to shunt the radiofrequency line to electrical ground: the radiofrequency signal then flows from the line carrying the signal RF toward electrical ground via the membrane. The two portions of line, before and after the membrane, are then isolated: the micro-switch is in the off state.

The main advantages of these types of series or parallel micro-switches are essentially:

- The fabrication techniques, which are derived from the conventional technologies for the fabrication of electronic integrated circuits. They allow the fabrication and integration to be simplified and, consequently, low fabrication costs to be obtained compared with those of other technologies, while at the same time guaranteeing a high level of reliability;
- The very low electrical powers consumed, a few nanojoules being required for the activation;
- The size. A micro-switch is thus fabricated within a surface area of the order of a tenth of a millimeter squared, allowing a high level of integration to be attained;
- The performance in microwave applications. This type of micro-switch exhibits very low insertion losses, of the order of a tenth of a deciBel, well below those of devices providing the same functions.

The desire for higher switching speeds, for higher RF power capabilities equal to or higher than the ten watt level, for wideband operation of at least 18 GigaHertz, for the smallest possible compactness and still at lower cost, for even longer lifetimes (number of switching operations), of the order of at least $10^{11}$ in order to meet the needs and evolutionary development of the market, notably of consumer markets such as for example mobile telephony, is driving the search for optimized structures and fabrication processes, the known micro-switch structures not completely meeting these needs.

SUMMARY OF THE INVENTION

The subject of the invention is accordingly a structure and a fabrication method for a micro-switch which allows all of these various needs to be met. It is just as applicable to both a series and a parallel micro-switch.

As characterized, the invention therefore relates to the structure of a radiofrequency or microwave micro-switch of the capacitor type with a first capacitor plate comprising a voltage controlled electrode disposed in a switching region between a first conducting line, called input signal line, and a second conducting line, called output signal line, disposed in the projected extension of one another, separated by the switching region, a second capacitor plate being a flexible membrane disposed above said switching region, the two capacitor plates being separated by a thickness of vacuum or of gas and at least one layer of a dielectric material, two parallel ground lines being disposed symmetrically with respect to the signal lines, said structure being formed on an insulating substrate coated with a passivation layer. According to the invention, the structure is such that:

said control electrode is formed on said passivation layer, said layer of dielectric material has a high relative permittivity greater than a hundred, and it is deposited onto said control electrode, in such a manner that in the direction of the input and output lines, said dielectric material only rests on said control electrode and, in the orthogonal direction, said dielectric material protrudes on either side and comes into contact with said passivation layer of the substrate, the flexible membrane is conducting and comprises at least one layer of a conducting material.

at least one insulating layer made of a material different from that of the passivation layer separates the level of the ground lines from the level of the signal lines.

Said high permittivity material is preferably PZT (Lead Zirconium Titanate, PbZrTiO3).

According to one embodiment of the invention, the metal membrane comprises a lower layer of a resistive material, typically a Titanium-Tungsten alloy and a low-resistance layer, of a material capable of handling the mechanical stress, selected from amongst Al, Au, Cu, preferably Al.

For use as a variable capacitor, in which it is desired to control the displacement of the membrane between the rest position and a maximum position between the dielectric and the rest position, the membrane is formed from a single layer of aluminum.

The invention also relates to a fabrication method for a radiofrequency or microwave micro-switch, for such a micro-switch on an insulating substrate coated with a passivation layer, characterized in that it comprises at least the following succession of steps:

a). Formation of the control electrode;

b). Formation of the dielectric, on said control electrode, c). Deposition over the whole surface of a first resistive conducting layer and of a second low-resistance conducting layer, and etch of the second layer, in order to form the input/output signal lines and bump contacts, d). Deposition over the whole surface of an insulating layer, made of a material different from that of the passivation layer, then opening onto the signal lines, of the bump contacts and onto the dielectric, e). Deposition over the whole surface of a first resistive conducting layer and of a second low-resistance conducting layer, and etch of the second layer, in order to form the ground lines, f). Deposition of a given thickness of photoresist over the whole surface and localized refilling up to the height of photoresist of the material of said second low-resistance conducting layer for the signal and ground lines, g). Localized etch, under the location of the membrane, of the first conducting layer deposited in step e).

h). Formation of the membrane;

i). Liberation of the membrane, by elimination of the layer of photoresist from step f).

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF DESCRIPTION OF THE DRAWINGS

The invention will be better understood and other advantages will become apparent upon reading the description that follows, given as a non-limiting example and with reference to the appended figures, among which.

DETAILED DESCRIPTION OF THE INVENTION

Figure 1A:
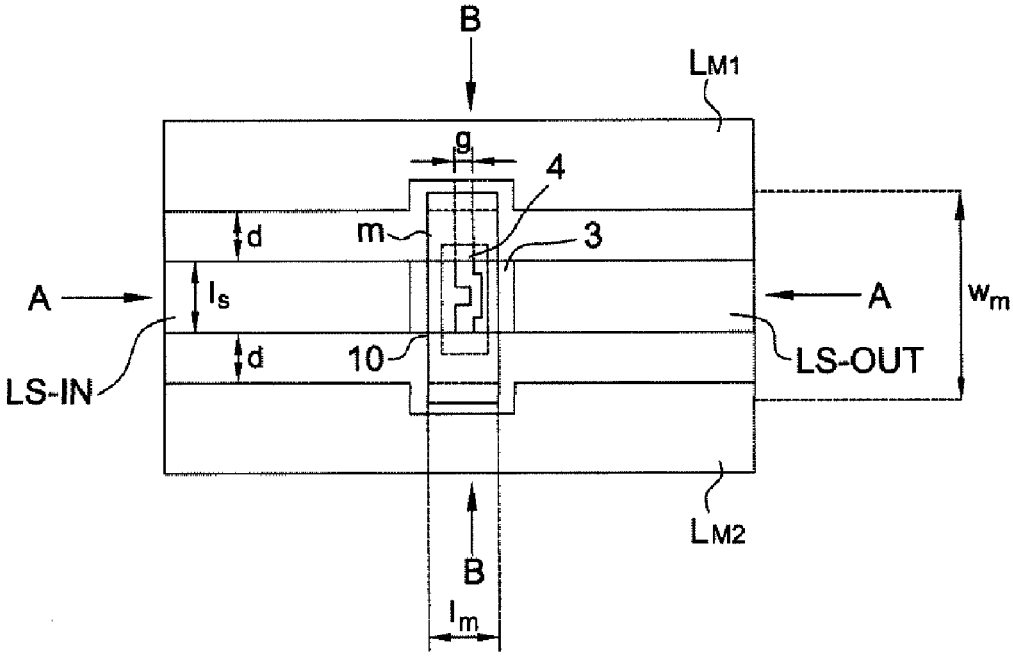
FIGS. 1*a* to 1*c* illustrate a series switch structure according to the invention.
Figure 1B:
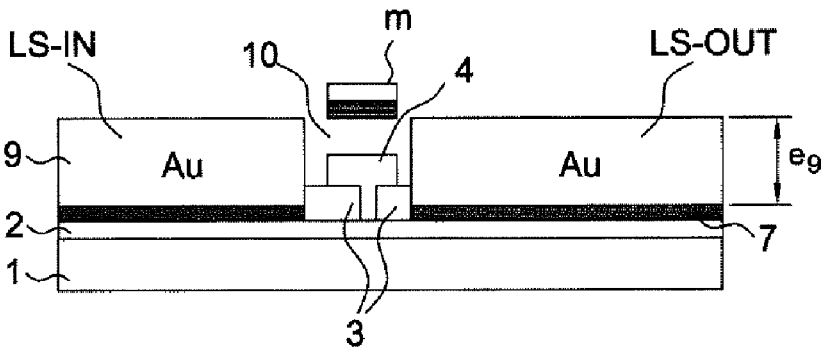
Figure 1C:
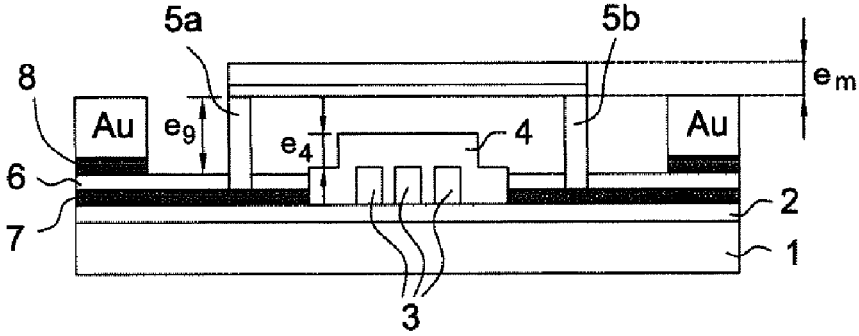
Figure 2A:
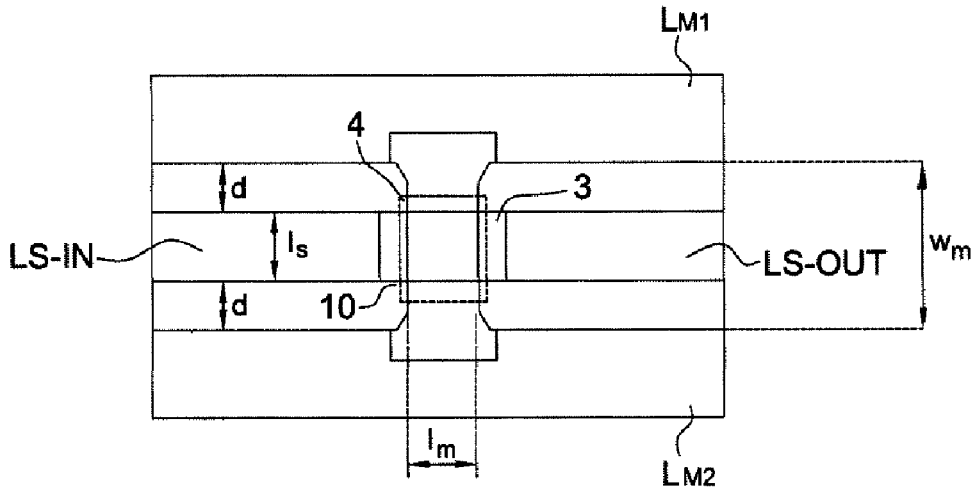
FIGS. 2*a* to 2*c* illustrate a parallel switch structure according to the invention.
Figure 2B:
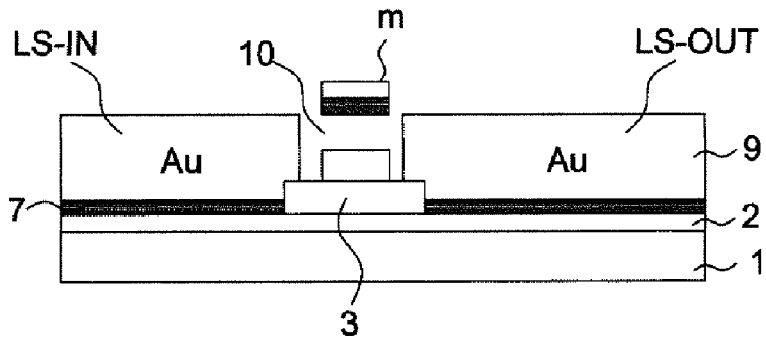
Figure 2C:
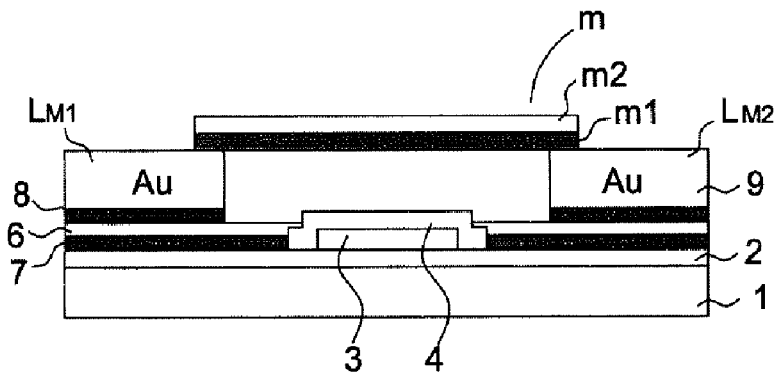

A radiofrequency or microwave micro-switch structure according to the invention is illustrated in FIGS. 1*a* to 1*d*, for a micro-switch of the series type or in FIGS. 2*a* to 2*c* for a micro-switch of the parallel type.

A structure according to the invention comprises, on a substrate 1 coated with a passivation layer 2, a first signal line LS-IN and a second signal line LS-OUT disposed in the projected extension of one another, separated by a switching region 10; a control electrode 3 in said region, a dielectric material 4 with high relative permittivity invariant with frequency, disposed on the control electrode in such a manner that, between the two signal lines, the control electrode is wider on either side and, in the orthogonal direction, the dielectric protrudes on either side of the control electrode and rests on the passivation layer; parallel ground lines, disposed symmetrically on either side of the signal lines and formed on a topological level separated from that of the signal lines by at least one insulating layer 6 made of a material different from that of the passivation layer, The insulating material is advantageously silicon nitride $Si_3N_4$.

The dielectric material is advantageously PZT whose relative permittivity is equal to 150, and is independent of frequency, which contributes to increasing the width of the operating frequency band of the micro-switch. Furthermore, the PZT which has a single-crystal structure is very resistant to significant RF power levels.

A micro-switch structure of the series type will now be described in more detail. FIG. 1*a* shows a top view of such a micro-switch and FIGS. 1*b* and 1*c* are respective cross-sectional views along AA, and along BB.

This structure is formed by superposition of layers on a base substrate 1, typically a highly-resistive silicon substrate, coated with a passivation layer 2, typically of silicon dioxide $SiO_2$.

It comprises two signal lines LS-IN and LS-OUT disposed in a coplanar manner in the projected extension of one another, separated by a switching region 10. In the switching region, a control electrode 3 is formed between the two signal lines, in two electrically isolated parts: each part is in contact with a signal line. A dielectric 4 with high relative permittivity greater than a hundred and invariant with frequency is deposited on the control electrode 3. It has a shape such that, in the direction of the signal lines, the control electrode is wider on either side, and in the orthogonal direction, it protrudes on either side of the control electrode 3, onto the passivation layer 2.

The dielectric 4 must allow the constraints of high radiofrequency and microwave powers to be met: in transmission in the on (conducting) state (membrane in the position bent downward, in contact with the dielectric), and in the isolated off or open state (membrane in the initial high position).

The dielectric 4 is preferably PZT, which combines the advantages of having a high relative permittivity of greater than a hundred (typically 150), invariant with frequency, of being capable of working at microwave frequencies up to 100 GigaHertz, and of handling the power levels, owing to its single-crystal nature.

In practice, the gap separating the two parts of the control electrode has a width g of around 10 microns. The break between the two parts can have a straight cross-section. It is advantageously such that the two parts are interdigitated. In a known manner, such a shape allows the dielectric capacitance of the capacitor formed by the membrane m, the control electrode 3 and the dielectric 4 to be significantly increased.

Preferably, the control electrode is formed from a Titanium-Platinum alloy onto which is deposited a Platinum/Gold layer in order to satisfy technological requirements At each end, the membrane m rests on a conducting pillar 5*a*, 5*b*. It may also be envisioned that only one of the two conducting pillars supports the membrane.

Ground lines LM1 and LM2 are formed on the same face of the substrate as the signal lines LS-IN and LS-OUT. These coplanar ground lines are formed on a topological level separated from the level of the input/output signal lines by an insulating layer 6, of a material different from that used for the passivation layer. In this way, it is certain that a short-circuit will not occur between a signal line and a ground line, via the substrate. The technical effect of this is that the micro-switch structure according to the invention is able to go very high in frequency, typically up to at least 100 GigaHertz. The insulating material used is advantageously silicon nitride.

Figure 4A:
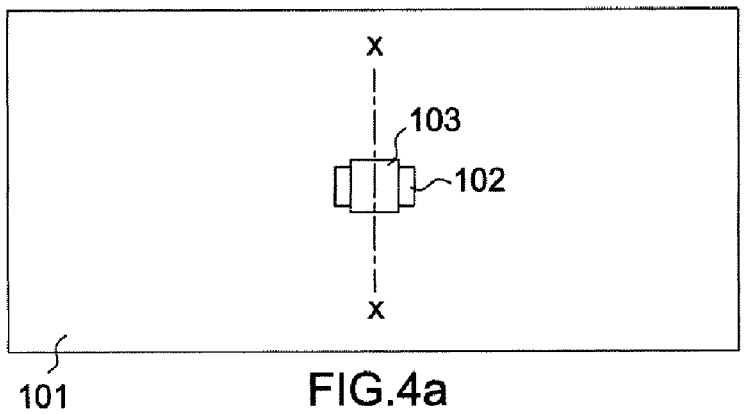
Figure 4B:
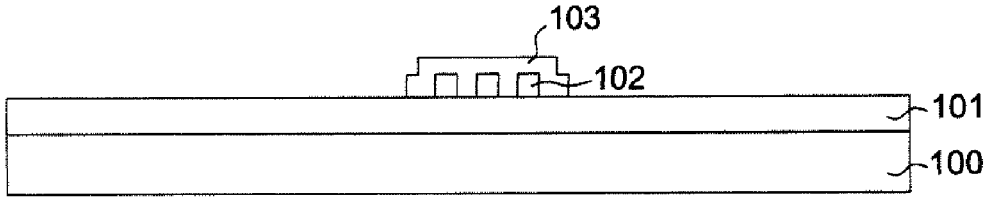

The pillars, the signal lines and the ground lines comprise typically a first conducting adhesion layer, which is resistive, shown as a thick dark line in FIGS. 4*b* and 4*c*, and a second layer with low resistance, typically of gold. The first layer is sufficiently resistive to prevent the propagation of a radiofrequency or microwave signal. This is typically a layer of Titanium-tungsten, preferably with 80% of Titanium and 20% of tungsten to within 1 or 2%, using which the best radiofrequency and microwave performances are obtained.

The layer of titanium-tungsten 7 for the signal lines and for the pillars is also used for the fabrication of the connection lines via which an activation voltage for the micro-switch can be applied in the switching region. In practice, at least one bump contact (not shown in FIGS. 4*a* to 4*c*) is formed in the same way as the signal line and the pillars, on the same topological levels, and a connection line is formed between this bump contact and at least one signal line. Preferably, the bump contact is connected to both signal lines LS-IN and LS-OUT, such that the voltage appears on both parts of the control electrode 3. The disposition in the form of interdigitated fingers allows there to be a metal part substantially in the middle under the membrane. These two features combined allow a maximum electrostatic field to be obtained substantially in the middle of the membrane, which guarantees optimum on and off switching times.

The conducting membrane comprises:

- a resistive adhesion conducting layer, typically of titanium-tungsten, situated facing the switching region. This layer is sufficiently resistive to prevent the propagation of a radiofrequency or microwave signal. The titanium-tungsten preferably has a proportion of 80% of titanium and 20% of tungsten to within 1 or 2%, as previously indicated.
- a highly conducting layer. This may be a dielectric. Preferably, a metallic material is chosen, selected from amongst Al, Cu and Au. These metals are selected for their low electrical resistivity and their capacity to handle mechanical stresses greater than 30 megapascals: the membrane must be capable of deforming in order to come into contact with the dielectric 4 without breaking (on state), and of returning to its initial state (off state). Preferably, aluminum is used, with which the best results are obtained in terms of switching speed and tolerance to mechanical stress.

The membrane is fabricated in the form of a grid, in other words it has holes passing through it from one side to another. This configuration contributes to facilitating the formation of the membrane, as will be seen with reference to the fabrication method, since it facilitates the passage of solvents or of gas for eliminating the layer of sacrificial photoresist which serves as plane support for the formation of the membrane. This configuration also contributes to improving the flexibility of the membrane. Finally, the grid shape is well known as a high-performance shape in the radiofrequency and microwave field.

In one preferred embodiment, the series micro-switch has the following design characteristic dimensions:

The cross-section of the signal lines has a width ls of 80 microns, and the distance d separating on either side the signal line from the ground line is equal to 120 microns.

The layer of gold e9 for the signal lines and for the pillars has a thickness of around 3 microns. The control electrode has a thickness of around 0.7 microns. The thickness of the ground lines is not an important parameter. It is substantially equal to that of the signal lines, to within 0.2 to 0.4 microns, the negligible difference depending on the technological process. The layer 4 of PZT has a thickness e4 of less than a micron, for example 0.4 micron. The width of the protrusion on either side of the dielectric is around 20 microns.

The mobile part of the membrane, in other words not including the pillars, takes the form of a rectangular parallelepiped, whose dimensions are advantageously: a width lm of 100 microns, in the direction of the signal lines, and a length wm, between the two pillars, of around 280 microns. The total thickness em of the membrane is around 0.7 microns, the first layer of titanium-tungsten being of lower thickness than the second layer. In one example, the layer of titanium-tungsten has a thickness of 0.2 microns.

The structure of a parallel micro-switch according to the invention is illustrated in FIGS. 2*a* (top view), 2*b* and 2*c* (respective cross-sectional views along AA and BB), which use the same references as in FIGS. 1*a* to 1*c*. The structure is substantially identical to that of the series micro-switch. The differences are related to the specificities of the parallel type with respect to the series type. Notably, since the membrane rests directly on the ground lines, there are no pillars 5*a*, 5*b*, and the control electrode has a continuous shape and is in contact on each side with a signal line. For these reasons, the previous description presented in correspondence with FIGS. 1*a* to 1*c* is applicable in the same manner, with the caveats that have just been mentioned.

The preferred design characteristic dimensions for a parallel micro-switch according to the invention are identical to those previously indicated for the series structure.

In one variant that is just as applicable to the series mode as the parallel, the membrane is formed by a single layer of aluminum, preferably with a thickness of around 2.5 microns, allowing a capacitor with variable capacitance to be fabricated, the activation voltage then defining the value of the capacitance, as a function of the displacement imposed on the membrane.

The series and parallel micro-switches according to the invention have good radiofrequency and microwave performances notably for the transmission of signals with significant radiofrequency or microwave power levels, of the order of ten or more watts.

A fabrication method for a micro-switch advantageously used in the invention, such as is described with reference to FIGS. 3*a* to 3*c*, will now be described. It is illustrated by FIG. 10*a* and the following figures, which shown its various steps.

Initially, each conducting element: signal lines, ground lines, bump contacts, membrane are formed by a first, very resistive, conducting layer and a second low-resistance conducting layer.

Preferably, the first layer is an alloy of titanium-tungsten in the proportion of 80% of titanium and 20% of tungsten to within 1 or 2%, and the second layer is a layer of gold, this choice having enabled the best performance characteristics to be obtained. In the description of the steps of the method, for simplicity, the materials titanium-tungsten and gold are directly mentioned, but other materials, such as copper and aluminum for example, could be used without straying from the scope of the invention.

Figure 3A:
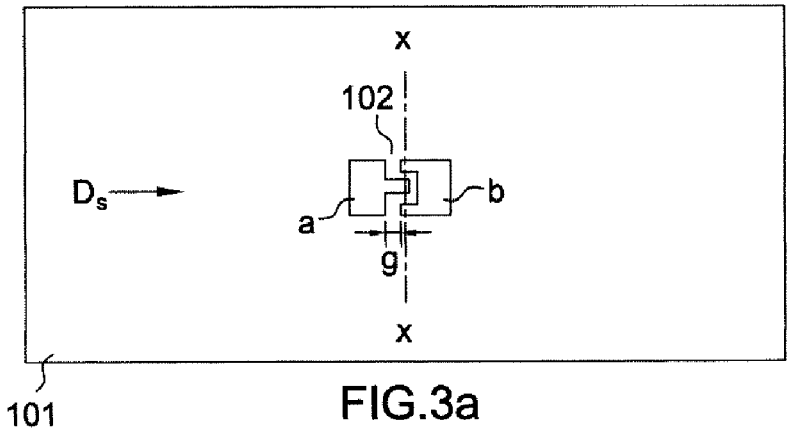
FIG. 3*a* and the following figures up to FIG. 12 illustrate steps of a method according to the invention.
Figure 3B:
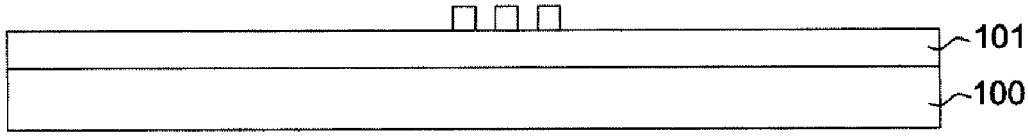

Step 1, FIGS. 3*a* (top view) and 3*b* (cross-section along X). A substrate 100, preferably made of highly resistive silicon (or GaAs, GaN, etc.), is used. On this substrate 100, a passivation layer of silicon dioxide $SiO_2$ (relative permittivity 4) is deposited. The control electrode 102 is formed, with its shape in two isolated parts a, b, preferably interdigitated as illustrated. The width g of the gap between the two parts is typically 10 microns. The control electrode is for example formed from a Titanium/Platinum alloy onto which a layer of Gold/Platinum is deposited.

Step 2, FIGS. 4*a* and 4*b*. The dielectric PZT 103 is formed on the control electrode according to the prescribed shape, typically by a process of the sol-gel type or by sputtering: narrower in the direction Ds of the signal lines and wider on either side in the orthogonal direction, lying on the passivation layer 101.

Figure 5A:
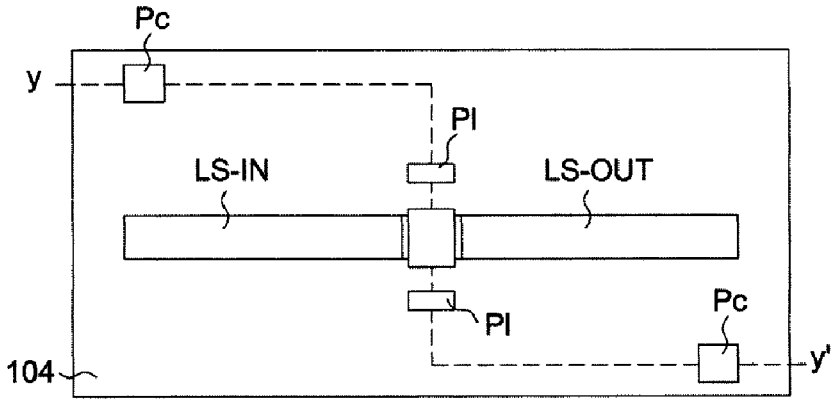
Figure 5B:
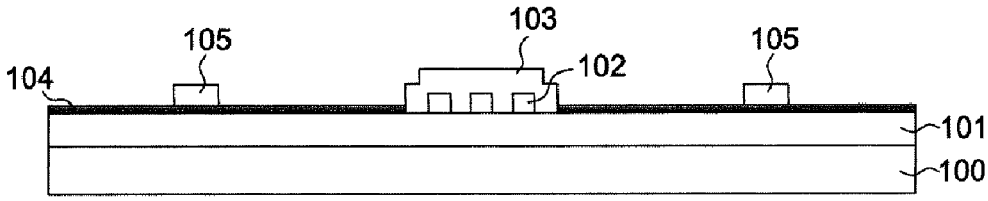

Step 3, FIGS. 5*a* (top view) and 5*b* (cross-section along YY'). Formation of the signal lines LS-IN and LS-OUT, of the bump contacts Pc, and of the pillars Pl, by deposition of a layer of Titanium/tungsten 104, deposition and etch of a layer of gold 105. The surface layer is then the layer 104.

Figure 6A:
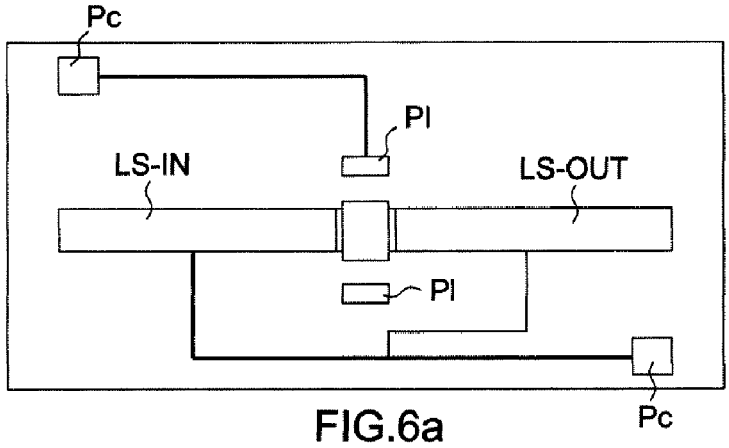
Figure 6B:
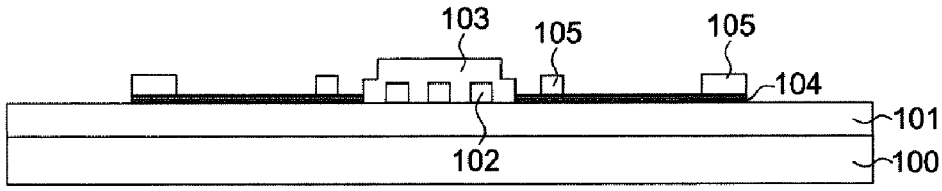

Step 4, FIGS. 6*a* and 6*b*: etch of the layer 104 of titanium/tungsten, so as to form connection lines between a bump contact between one or both of the two signal lines (in order to apply an activation voltage to one or both of the two parts of the control electrode), and a bump contact and a pillar in order to bias the membrane to a reference potential (electrical ground which is not the ground of the micro-switch circuit). The remainder of the surface layer, outside of the fabricated elements, is the passivation layer 101.

Figure 7A:
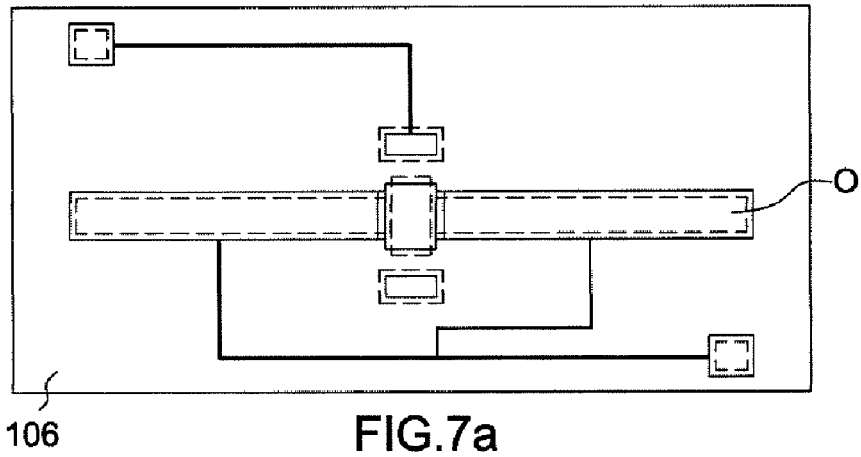
Figure 7B:
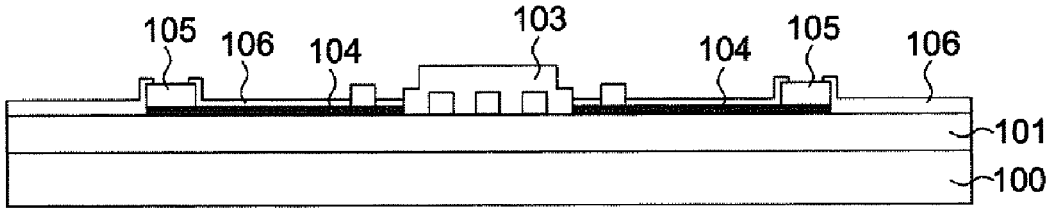

Step 5, FIGS. 7*a* and 7*b*. Deposition of the insulating layer of silicon nitride $Si_3N_4$, then opening O onto the signal lines, and the bump contacts, the pillars and the dielectric 103, indicated by the dashed lines. The surface layer is this insulating layer 106.

Figure 8A:
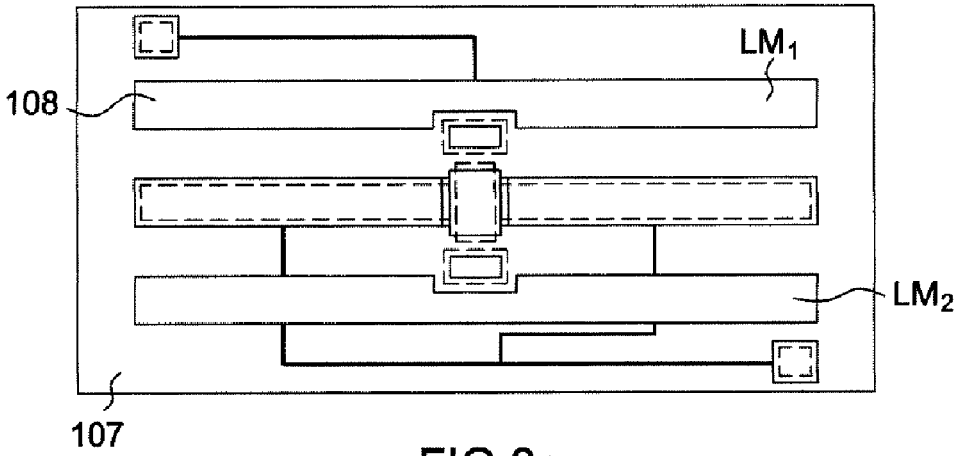
Figure 8B:
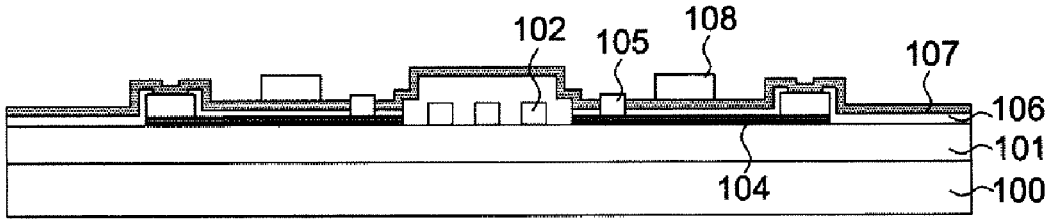

Step 6, FIGS. 8*a* and 8*b*. Deposition of a layer 107 of Titanium/tungsten and deposition and etch of a layer of gold 109, in order to form the ground lines LM1 and LM2. The surface layer is the layer 107 of Titanium/tungsten.

Figure 9A:
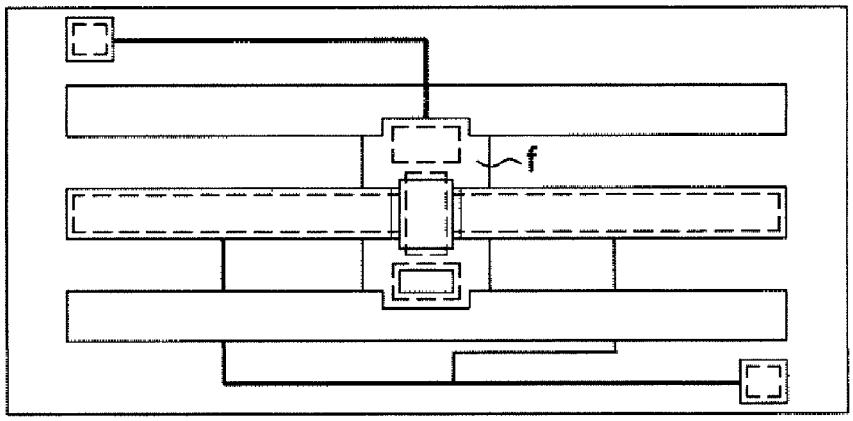
Figure 9B:
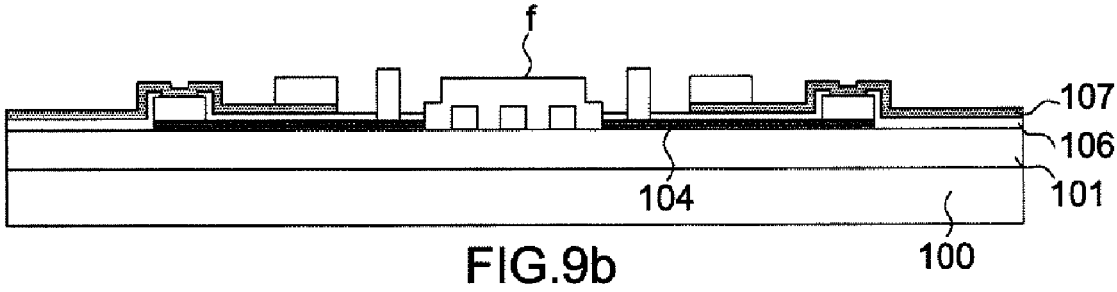

Step 7, FIGS. 9*a* and 9*b*. Localized etch-back of Titanium-tungsten within a region f under the location of the membrane.

Figure 10:
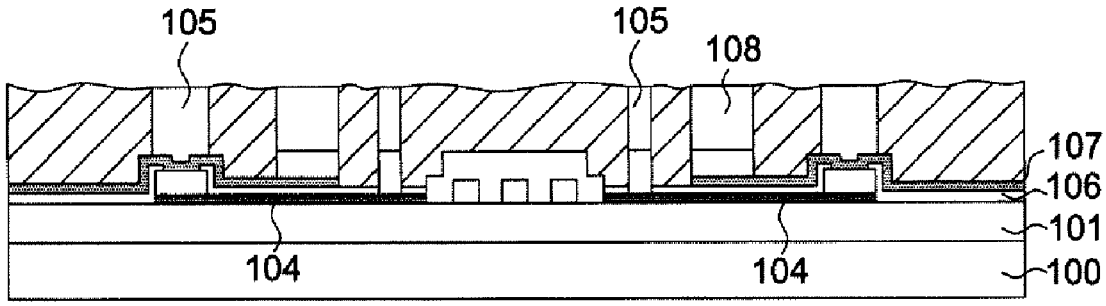

Step 8, FIG. 10. Localized refilling with gold, by prior deposition of photoresist over the whole surface and by injection of current via the bump contacts and the connection lines. The height of gold thus obtained is controlled by the thickness of photoresist. In practice, the thickness (or the height) of gold for the signal lines and for the pillars reaches 3 microns. The thickness of the ground lines is substantially equal, in practice with a negligible difference of around 0.2 to within 0.4 microns (less). The photoresist allows the same level to be attained everywhere, which guarantees the planarity of the membrane formed in the following step.

Figure 11A:
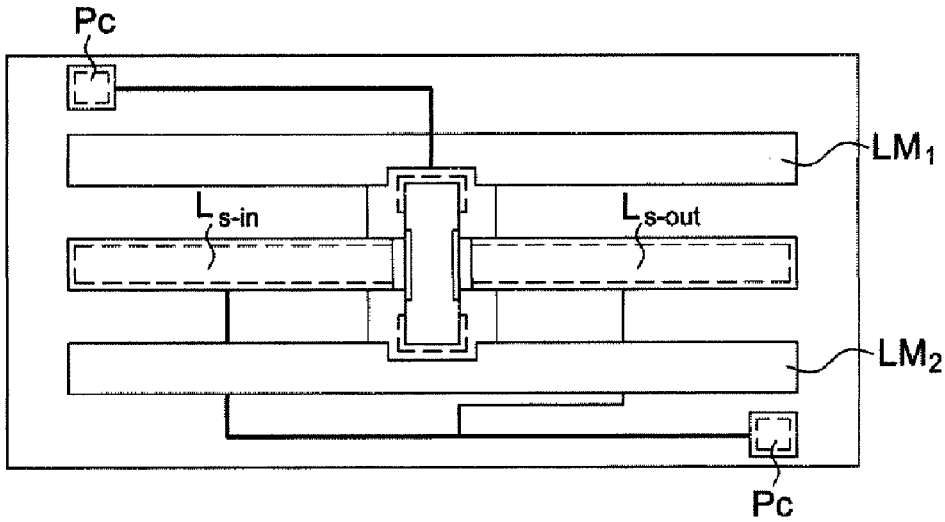
Figure 11B:
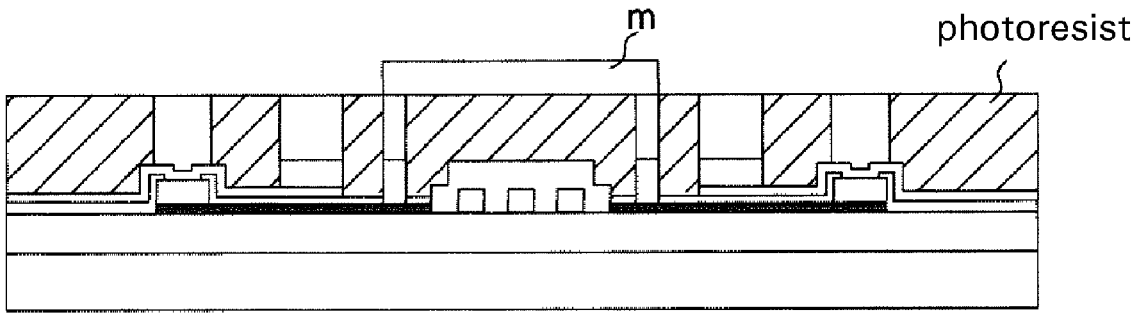

Step 9, FIGS. 11*a* and 11*b*. Formation of the membrane by deposition of titanium-tungsten then deposition of Aluminum (or Gold, or Copper), and etch of the membrane. Preferably, the thickness of titanium-tungsten is equal to 0.2 microns and the thickness of Gold is equal to 0.5 microns. For a micro-switch used as a variable capacitor, as in the impedance matching circuit, this step 9 comprises deposition of a single layer of aluminum with a thickness of around 2.5 microns, then etch.

Figure 12:
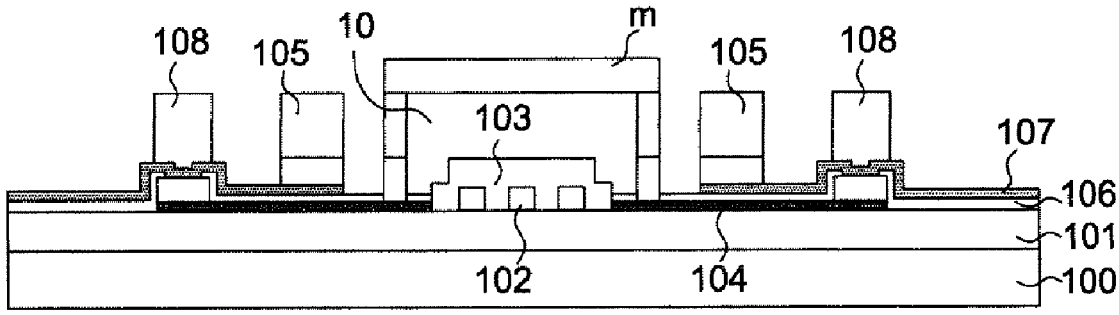

Step 10, FIG. 12: liberation of the membrane by elimination of the layer of photoresist from step 8, for example by solvents. This operation is facilitated by a membrane drilled with holes. Such a membrane structure furthermore has the effect of making the membrane less rigid, which contributes to improving the latency.

This method is also applicable for switches of the parallel type which differ from series micro-switches simply in that there are no pillars, since the membrane rests directly on the ground lines, and by reason of its continuous shape, with no beak in the control electrode between the two signal lines.

The succession of the steps of the method which have just been described lead to a micro-switch structure whose radiofrequency performance in terms of transmission, isolation, switching time, the lifetime and the width of the frequency band are substantially improved.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by definition contained in the appended claims and equivalents thereof.

The invention claimed is:

1. A structure of a radiofrequency or microwave micro-switch of the capacitor type with a first capacitor plate comprising a voltage controlled electrode disposed in a switching region between a first conducting line, called input signal line, and a second conducting line, called output signal line, disposed in the projected extension of one another, separated by the switching region, a second capacitor plate being a flexible membrane disposed above said switching region, the two capacitor plates being separated by a thickness of vacuum or of gas and at least one layer of a dielectric material, two parallel ground lines being disposed symmetrically with respect to the signal lines, said structure being formed on an insulating substrate coated with a passivation layer, wherein:

said control electrode is formed on said passivation layer, said layer of dielectric material has a high relative permittivity greater than a hundred, and it is deposited onto said control electrode, in such a manner that in the direction of the input and output lines, said dielectric material only rests on said control electrode and, in the orthogonal direction, said dielectric material protrudes on either side and comes into contact with said passivation layer of the substrate, the flexible membrane is conducting and comprises at least one layer of a conducting material, at least one insulating layer, made of a material different from that of the passivation layer, separates the level of the ground lines from the level of the signal lines.

2. The structure as claimed in claim 1, wherein said dielectric is PZT.

3. The structure as claimed in claim 1 wherein said insulator is silicon nitride $Si_3N_4$.

4. The micro-switch structure as claimed in claim 1, wherein the thickness of the signal lines is around 3 microns, and the thickness of the control electrode is around 0.7 micron.

5. The micro-switch structure as claimed in claim 1, wherein the signal lines and the ground lines comprise a highly resistive lower layer and an upper layer with low resistance.

6. The micro-switch structure as claimed in claim 5, wherein said lower layer is a layer of titanium-tungsten being an alloy with a proportion of 80% of titanium and 20% of tungsten to within 1 or 2%.

7. The micro-switch structure as claimed in claim 1, wherein the membrane comprises a highly resistive lower layer, facing the switching electrode made of titanium-tungsten, and an upper layer made of a material selected from amongst Al, Cu, Au.

8. The micro-switch structure as claimed in claim 7, wherein the total thickness of the membrane is around 0.7 microns, the thickness of the upper layer being around 0.5 microns.

9. The structure as claimed in claim 1, wherein the membrane is formed from a single layer of aluminum with a thickness of around 2.5 microns, for use as a variable capacitor.

10. The micro-switch structure as claimed in claim 1, wherein the thickness of dielectric is around 0.4 microns.

11. The micro-switch structure as claimed in claim 1, wherein the width of the signal lines is equal to 80 microns, and the distance to each ground line is 120 microns.

12. The structure as claimed in claim 11, wherein the part of the shape of the membrane not including the pillars falls substantially within a rectangular parallelepiped having a length between the pillars of around 280 microns, and a width of around 100 microns.

13. The micro-switch structure of the series type as claimed in claim 1, wherein said control electrode comprises at least two separate parts, each being in contact with one of the signal lines, a gap region between the two parts being situated substantially in the middle of the switching region and in that said membrane rests at each end on a pillar disposed between the signal lines and one ground line.

14. The structure as claimed in claim 13, wherein the length of each protrusion of the dielectric onto the passivation layer is around 20 microns.

15. The structure as claimed in claim 12, wherein said parts of the control electrode are interdigitated.

16. The micro-switch structure of the parallel type as claimed in claim 1, the membrane resting at each end on one ground line and the control electrode having a single-unit shape connecting the signal lines on either side.

17. A fabrication method for a radiofrequency or microwave micro-switch as claimed in claim 1 on an insulating substrate coated with a passivation layer, wherein it comprises at least the following succession of steps:

a) formation of the control electrode;

b) formation of the dielectric, on said control electrode, c) deposition over the whole surface of a first resistive conducting layer and of a second low-resistance conducting layer, and etch of the second layer, in order to form the input/output signal lines and bump contacts, d) deposition over the whole surface of an insulating layer, made of a material different from that of the passivation layer, then opening onto the signal lines, of the bump contacts and onto the dielectric, e) deposition over the whole surface of a first resistive conducting layer and of a second low-resistance conducting layer, and etch of the second layer, in order to form the ground lines, f) deposition of a given thickness of photoresist over the whole surface and localized refilling up to the height of photoresist of the material of said second low-resistance conducting layer for the signal and ground lines, g) localized etch, under the location of the membrane, of the first conducting layer deposited in step e)

h) formation of the membrane i) liberation of the membrane, by elimination of the layer of photoresist from step f).

18. The fabrication method as claimed in claim 17, wherein the layer of dielectric material is deposited by a sol-gel process or by sputtering.

19. The fabrication method as claimed in claim 17, wherein the membrane is drilled with holes.

20. The fabrication method as claimed in claim 17 for a micro-switch of the series type, wherein, in step c), pillars are also formed, to which step f) for localized refilling applies, the membrane formed in step i) resting at each end on said pillars.

* * * * *